US012097991B2

(12) United States Patent
Hasegawa et al.

(10) Patent No.: US 12,097,991 B2
(45) Date of Patent: Sep. 24, 2024

(54) BOTTLE CAN, MANUFACTURING METHOD OF BOTTLE CAN, AND DESIGN METHOD OF BOTTLE CAN

(71) Applicant: Universal Can Corporation, Tokyo (JP)

(72) Inventors: Takashi Hasegawa, Sunto-gun (JP); Tomoaki Iimura, Sunto-gun (JP)

(73) Assignee: Universal Can Corporation, Tokyo (JP)

( * ) Notice: Subject to any disclaimer, the term of this patent is extended or adjusted under 35 U.S.C. 154(b) by 426 days.

(21) Appl. No.: 17/310,269

(22) PCT Filed: Jan. 29, 2020

(86) PCT No.: PCT/JP2020/003227

§ 371 (c)(1),
(2) Date: Jul. 27, 2021

(87) PCT Pub. No.: WO2020/158817

PCT Pub. Date: Aug. 6, 2020

(65) Prior Publication Data

US 2022/0055785 A1 Feb. 24, 2022

(30) Foreign Application Priority Data

Jan. 31, 2019 (JP) ..... 2019-016367
Dec. 19, 2019 (JP) ..... 2019-229557

(51) Int. Cl.
*B65D 1/02* (2006.01)
*B21D 51/24* (2006.01)
*B21D 51/26* (2006.01)

(52) U.S. Cl.
CPC ..... *B65D 1/0246* (2013.01); *B21D 51/24* (2013.01); *B21D 51/26* (2013.01);
(Continued)

(58) Field of Classification Search
CPC .. B65D 1/0246; B65D 1/0276; B65D 1/0207; B65D 1/0223; B21D 51/24; B21D 51/26; B21D 51/2638
See application file for complete search history.

(56) References Cited

U.S. PATENT DOCUMENTS 5,718,352 A 2/1998 Diekhoff et al.
8,016,148 B2 * 9/2011 Walsh ..... B65D 1/0207 215/44

(Continued)

FOREIGN PATENT DOCUMENTS

JP 2002-292434 A 10/2002
JP 2006-062755 A 3/2006

(Continued)

OTHER PUBLICATIONS

Extended European Search Report mailed Sep. 22, 2022 for the corresponding European Patent Application No. 20747773.8 (11 pages).

(Continued)

*Primary Examiner* — Nathan J Jenness
*Assistant Examiner* — Jennifer Castriotta
(74) *Attorney, Agent, or Firm* — Leason Ellis LLP; Melvin C. Garner; Mitsuhiro Haraguchi

(57) ABSTRACT

A bottle can made of aluminum alloy has a base portion; a cylindrical body portion connected to an upper end of the base portion; a reduced diameter portion where a diameter reduces from an upper end of the cylindrical body portion to an upper side; a neck portion provided at an upper side of the reduced diameter portion; and a mouth portion having a male thread portion and a bulge portion provided at an upper side of the neck portion. The reduced diameter portion has: a convex curved portion continuing to the upper end of the cylindrical body portion; a concave curved portion continuing to an upper end of the convex curved portion; a lower (Continued)

convex portion continuing to an upper end of the concave curved portion; and an upper concave portion continuing an upper end of the lower convex portion and a lower end of the neck portion.

9 Claims, 5 Drawing Sheets

(52) U.S. Cl.
CPC ..... *B21D 51/2638* (2013.01); *B65D 1/0207* (2013.01); *B65D 1/0223* (2013.01); *B65D 1/0276* (2013.01)

(56) References Cited

U.S. PATENT DOCUMENTS

| | | | | |
|---|---|---|---|---|
| 9,139,324 | B1 | 9/2015 | Watkins et al. | |
| 9,821,926 | B2 * | 11/2017 | Robinson | B21D 51/2638 |
| 10,961,009 | B2 * | 3/2021 | Tanaka | B65D 1/02 |
| 2007/0051687 | A1 * | 3/2007 | Olson | B65D 41/16 215/44 |
| 2013/0220964 | A1 | 8/2013 | Adams et al. | |
| 2014/0008320 | A1 | 1/2014 | Hosoi | |
| 2014/0263150 | A1 | 9/2014 | Robinson et al. | |

FOREIGN PATENT DOCUMENTS

| | | | |
|---|---|---|---|
| JP | 2018-061964 | A | 4/2018 |
| JP | 2018104094 | A | 7/2018 |
| JP | 2018-131261 | A | 8/2018 |
| JP | 2018-140826 | A | 9/2018 |
| JP | 2018-177250 | A | 11/2018 |
| JP | 2018-184188 | A | 11/2018 |
| WO | 2012133391 | A1 | 10/2012 |

OTHER PUBLICATIONS

International Search Report mailed Apr. 7, 2020 for the corresponding International Patent Application No. PCT/JP2020/003227.

* cited by examiner

21

22
222
t2
221
t1
11

23
231
232
12
132
131
11

24
241
13
12
134
133
132
131
11

1
134
133
14
15
13
132
131
12
11

BOTTLE CAN, MANUFACTURING METHOD OF BOTTLE CAN, AND DESIGN METHOD OF BOTTLE CAN

CROSS-REFERENCE TO RELATED PATENT APPLICATIONS

This application is a U.S. National Phase Application under 35 U.S.C. § 371 of International Patent Application No. PCT/JP2020/003227 filed on Jan. 29, 2020 and claims the benefit of priority to Japanese Patent Applications No. 2019-016367 filed Jan. 31, 2019, and No. 2019-229557 filed Dec. 19, 2019, the contents of all of which are incorporated herein by reference in their entireties. The International Application was published in Japanese on Aug. 6, 2020 as International Publication No. WO/2020/158817 under PCT Article 21(2).

FIELD OF THE INVENTION

The present invention relates to a bottle can filled with a content such as a beverage, a method of manufacturing the bottle can, and a method of designing the bottle can.

BACKGROUND OF THE INVENTION

Known as a can filled with a content such as a beverage, a bottle-shaped can (bottle can) is provided with a cylindrical body portion connected to a base portion, a reduced diameter part in which a diameter thereof reduces upward from an upper end of the cylindrical body portion toward an upper end in a can axis direction, a neck portion provided on an upper side of the reduced diameter portion in the can axis direction, and a mouth portion provided at an upper side of the neck portion in the axis direction and having a bulge-out portion bulging outward in a radial direction.

In such a bottle can, a can body having a bottomed-cylindrical shape is formed by performing a cupping process (drawing process) and a DI process (drawing-and-ironing process) on a metal plate material (plate material of aluminum alloy material); a reduced diameter part is formed by performing a diameter reduction process on the body portion of the bottomed-cylindrical can body; and then the mouth portion having a threaded portion, a curl portion and the like is formed.

As such a bottle can, for example, a bottle can described in Japanese Unexamined Patent Application, First Publication No. 2006-062755 and a bottle can described in Japanese Unexamined Patent Application, First Publication No. 2018-131261 are known.

In the bottle can described in Japanese Unexamined Patent Application, First Publication No. 2006-062755, a truncated cone portion is connected to a cylindrical side wall subjected to drawing and ironing. The truncated cone portion has a neck portion with a smaller diameter than a can body at the upper part. The neck portion is connected to a cylindrical portion; and a thread is formed on the cylindrical portion. A bead is formed above the cylindrical portion; and an annular bead is formed below the thread.

The bottle can is designed to have a diameter of about 76 mm and a height of about 180 mm, for about 590 ml. Alternatively, it is also described that about 207 ml to 946 ml or more may be filled in a range of a diameter of about 51 mm to 83 mm and a height of about 89 mm to 254 mm.

Moreover, it is described that the truncated cone form portion is not a straight truncated cone neck but preferably have a plurality of steps or ribs.

Japanese Unexamined Patent Application, First Publication No. 2018-131261 describes a bottle can in which a shoulder portion of a truncated cone surface shape in which a diameter gradually reduces with a constant inclination toward an upper end side, a cylindrical neck portion extending toward the upper end side from the shoulder portion, and a cap-attached portion (a mouth portion) provided with a bulged-out portion bulging radially outward from the upper end of the neck portion, a threaded portion, and a curl portion are formed above a body section with an outer diameter (diameter) of the body section of 64.24 mm to 68.24 mm and a content capacity for 410 ml.

CITATION LIST

Patent Document

Patent Document 1: Japanese Unexamined Patent Application, First Publication No. 2006-062755

Patent Document 2: Japanese Unexamined Patent Application, First Publication No. 2018-131261

Technical Problem

In the bottle can described in Japanese Unexamined Patent Application, First Publication No. 2006-062755, the truncated cone portion (the reduced diameter portion) between the cylindrical side wall and a cylinder portion having a small diameter and forming an opening portion are formed in a step shape, and is inferior in design.

In the bottle can described in Japanese Unexamined Patent Application, First Publication No. 2018-131261, the shoulder portion (the reduced diameter portion) is formed relatively smooth; however, since it is a truncated cone surface shape, a square impression is given as a whole. Moreover, since the shape of the connection portion between the upper end portion of the shoulder portion in the axis direction and the neck portion is convex toward the inside of the radial direction (the outer surface is concave), the strength in the radial direction of the bottle can at this portion is low, and the column strength (strength in the can axis direction) of the bottle can also become lower.

In a case of such a bottle can having a reduced diameter portion of the step shape or the truncated conical shape, there is a possibility that pulsation may occur when the beverage is poured out. In particular, when the content is increased, the effect of the pulsation is increased; and it is necessary to improve the pouring property.

The present invention is achieved in consideration of the above circumstances, and has an object to provide a bottle can, a manufacturing method of a bottle can, and a design method of a bottle can which can improve the strength of the bottle can in the radial direction, give a smooth and soft impression of a reduced diameter portion between the cylindrical body portion and the mouth portion, and have good pouring properties even if it has a large capacity.

SUMMARY OF THE INVENTION

Solution to Problem

A bottle can of the present invention is made of aluminum alloy, including a base portion; a cylindrical body portion having a cylindrical shape connected to an upper end of the base portion; a reduced diameter portion in which a diameter reduces from an upper end of the cylindrical body portion to an upper side; a neck portion provided at an upper side of the reduced diameter portion; and a mouth portion having a male thread portion and a bulge portion provided at an upper side of the neck portion and bulging out in a radial direction; in the bottle can, the reduced diameter portion is provided with: a convex curved portion forming a convex outer surface continuing to the upper end of the cylindrical body portion; a concave curved portion forming a concave outer surface continuing to an upper end of the convex curved portion; a lower convex portion forming a convex outer surface continuing to an upper end of the concave curved portion; and an upper concave portion forming a concave outer surface continuing an upper end of the lower convex portion and a lower end of the neck portion.

In the present invention, since the lower convex portion and the upper concave portion is formed to connect the upper end (upper end of the reduced diameter portion) of the concave curve portion and the lower end of the neck portion, the concave curved portion and the neck portion can be smoothly connected, and the design of the bottle can is able to be improved and the strength of the bottle can in the vicinity of the neck portion in the radial direction can be increased. Moreover, by increasing the strength of the bottle can in the radial direction in the vicinity of the neck portion, the column strength of the bottle can is able to be also increased.

Moreover, since the reduced diameter portion is formed between the cylindrical body portion and the mouth portion to connect the convex curved portion and the concave curved portion having a large radius of curvature, the appearance gives smooth and soft impressions, and the design is good. Furthermore, since the reduced diameter portion is formed smoothly, the beverage flows smoothly on the inner peripheral surface of the reduced diameter portion when the beverage is poured out from the mouth portion, and the pulsation is not easily generated. In particular, in a bottle can with a large content having a long cylindrical body portion and a large height, good pouring properties are shown.

Moreover, in a manufacturing process of the bottle can, although there is a process of cleansing the inside with conveying in an inverted posture, a runoff property of the cleansing liquid at this time is also good and the cleansing liquid is not easily remained inside.

Besides, since the convex curved portion and the concave curved portion having the large radius of curvature continue between the cylindrical body portion having a large diameter and the mouth portion having the small diameter, by grasping and holding the lower end part of the mouth portion with a thumb and a forefinger, the outer surface from the concave curved portion to the convex curved portion follows and is in contact with a concave of a palm, and a gripping feeling is good. Accordingly, stableness of holding is particularly excellent when it is applied on a large can having a large content.

As a preferable aspect of the bottle can of the present invention, it is preferable that a radius of curvature the outer surface of the lower convex portion be not less than 2 mm and not more than 6 mm.

As a preferable aspect of the bottle can of the present invention, it is preferable that a radius of curvature of the outer surface of the convex curved portion be not less than 45 mm and not more than 80 mm, and a radius of curvature of the outer surface of the concave curved portion be not less than 85 mm and not more than 115 mm.

A preferable aspect of the bottle can of the present invention, it is preferable that: a can height from a lower surface of the base portion to an upper surface of the mouth portion be not less than 194 mm and not more than 230 mm, a cylindrical body height from the lower surface of the base portion to an upper end of the cylindrical body portion be not less than 110 mm and not more than 150 mm, an upper portion height from a lower end of the reduced diameter portion to the upper surface of the mouth portion be not less than 60 mm and not more than 100 mm, an outer diameter of the cylindrical body portion be not less than 64 mm and not more than 68 mm, an upper-neck height from a lower end of the neck portion to the upper surface of the mouth portion be not less than 18 mm and not more than 24 mm, a mouth height from a lower end of the mouth portion to the upper surface of the mouth portion be not less than 15 mm and not more than 20 mm, and an outer diameter of the bulge portion be not less than 35 mm and not more than 40 mm.

In the above-described aspect, since the neck height is small as 3 mm to 5 mm inclusive, the cylindrical body height is large and the upper portion height is small, the can height can be small as 194 mm to 230 mm inclusive, and the stability of the can while conveying can be improved. By setting the outer diameter of the cylindrical body portion to 64 mm to 68 mm inclusive and structuring the reduced diameter portion from the convex curved portion and the concave curved portion, the content of the bottle can is able to be increased.

The manufacturing method of a bottle can of the present invention is a method of manufacturing the above-described bottle can, and is provided with: a cup forming step punching out an aluminum alloy sheet to form a cup; a cylindrical body forming step carrying out a drawing process and an ironing step on the cup to form a cylindrical body; a step of forming a reduced diameter cylindrical portion reducing a diameter of the cylindrical body toward an upper side of the can axis direction, to form a reduced diameter cylindrical portion having the convex curved portion and the concave curved portion and to form a small cylindrical portion continued to an upper end of the reduced diameter cylindrical portion and linearly extending upward; a step of forming a reduced diameter portion by pressing a mold having a smaller diameter than a diameter of the small cylindrical portion on an upper end portion of the small cylindrical portion and relatively moving in the can axis direction to form the reduced diameter portion by forming the lower convex portion and the upper concave portion continuing to an upper end of the concave curved portion and to form a second small cylindrical portion continuing to an upper end of the upper concave portion with a smaller diameter than the small cylindrical portion; and a mouth portion forming step forming the bulge portion on an upper end portion of the second small cylindrical portion and the male thread portion on an upper side of the bulge portion in the can axis direction.

In a case in which the aluminum alloy sheet to be the material of the bottle can is a rolled material, malleability when processing is different between a rolling direction and a cross direction, so that there is a tendency that it is made oval viewed in the cross-sectional view due to an external force when manufacturing or capping.

Whereas in the present invention, pressing the mold with the smaller diameter than the diameter of the small cylindrical portion on the upper end part of the small cylindrical portion and relatively moving to form the lower convex portion and the upper concave portion, the strength at the lower side of the bulge portion of the mouth portion and the neck portion can be improved. Thereby, the bottle can is suppressed from deforming due to the external force while capping and the bottle can with the oval shape in the cross-sectional view can be reformed to a perfect circle in the cross-sectional view in the manufacturing process.

As a preferable aspect of the manufacturing method of a bottle can of the present invention, it is preferable to further include a reforming step reducing the radius of curvature of the lower convex portion by pressing a reforming mold on an upper part of the lower convex portion and relatively moving in the can axis direction.

In the above-described aspect, since the lower convex portion is processed again in the reforming step, the shape of the bottle can affecting the sealability of a cap can be reliably reformed.

A design method of a bottle can of the present invention is a design method of a bottle can made of aluminum alloy provided with: a base portion; a cylindrical body portion having a cylindrical shape connected to an upper end of the base portion; a reduced diameter portion in which a diameter reduces from an upper end of the cylindrical body portion to an upper side; a neck portion provided at an upper side of the reduced diameter portion; and a mouth portion having a bulge portion provided at an upper side of the neck portion and bulges out in a radial direction and a male thread portion.

The design method includes: a dimension setting step, to set each of a can height, a cylindrical body height from a surface of the base portion at lower side in a can axis direction to an upper side end of the cylindrical body portion in the can axis direction, an upper portion height from a lower side end of the reduced diameter portion in the can axis direction to an upper side surface of the mouth portion in the can axis direction, an outer diameter of the cylindrical body portion, an upper-neck height from a lower end of the neck portion to an upper can surface of the mouth portion, a mouth height from a lower end of the mouth portion to an upper surface of the mouth portion, and an outer diameter of the bulge portion; a form setting step of the reduced diameter portion to set a radius of curvature of a convex curved portion forming a convex outer surface continued to the upper end of the cylindrical body portion in the reduced diameter portion and a radius of curvature of a concave curved portion forming a concave outer surface from the upper end of the convex curved portion to the lower end of the mouth portion, and to decide a position of an upper end of the concave curved portion; and a setting step of a connection form to set each form of: a lower convex portion forming a convex outer surface continued to the concave curved portion and connecting between the upper end of the concave curved portion and a lower end of the neck portion; and an upper concave portion forming a concave outer surface continued to an upper side of the lower convex portion and the neck portion.

In the present invention, the dimensions of the can height and the like of the bottle can are set, then the form of the reduced portion is set, and the forms of the lower convex portion and the upper concave portion connecting smoothly between the upper end of the concave curved portion and the lower end of the neck portion are set, so that it is possible to design the stable bottle can with a good design, having the high strength in the radial direction.

Advantageous Effects of Invention

According to the present invention, it is possible to improve the strength of the bottle can in the radial direction, show the appearance of the smooth and soft impression of the reduced diameter portion between the cylindrical body portion and the mouth portion, and improve the pouring property even if it is a large content.

DETAILED DESCRIPTION OF THE INVENTION

An embodiment of the present invention will be explained below referring the drawings.

Figure 1:
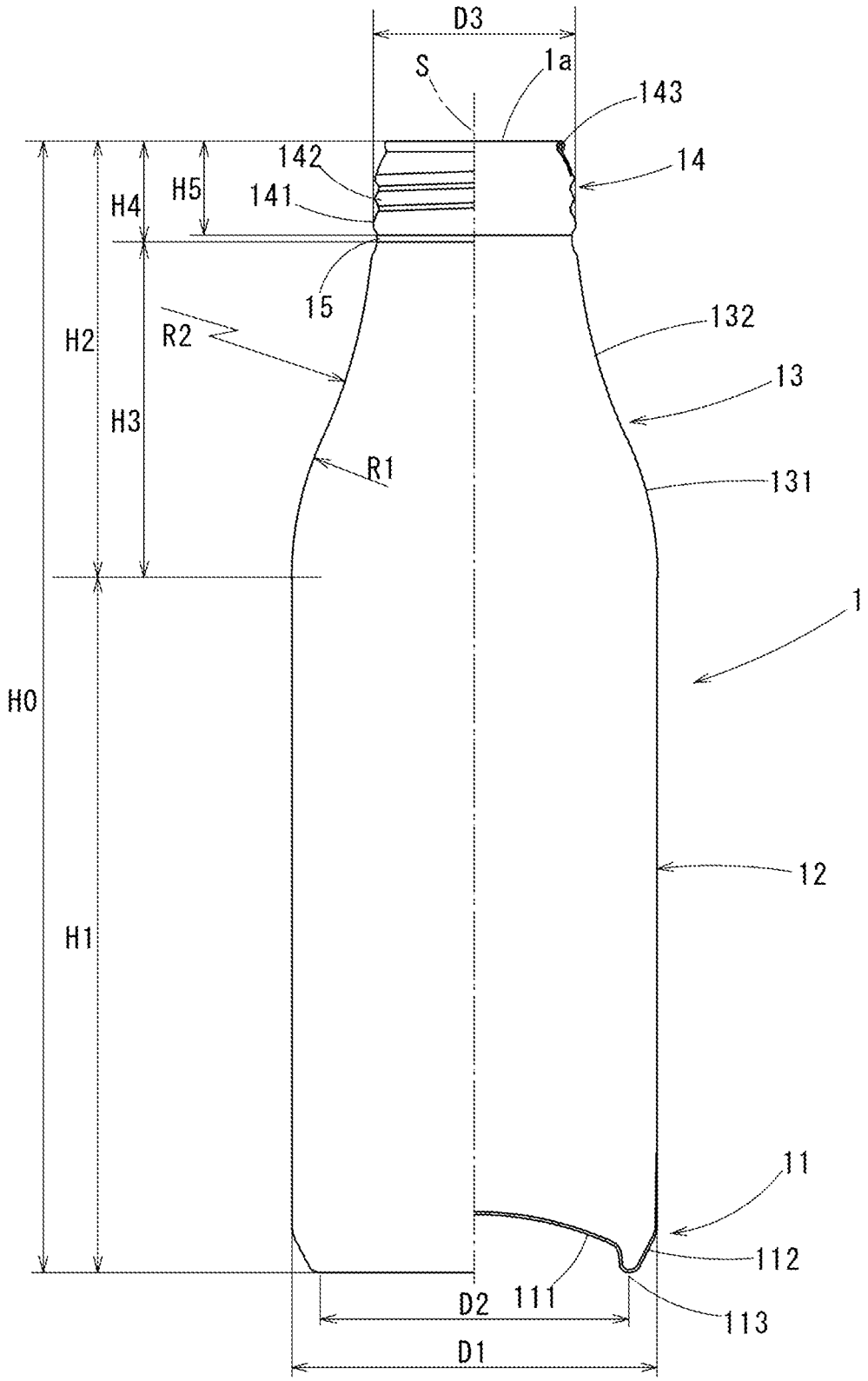
FIG. 1 is a front view in which half of a bottle can according to one embodiment of the present invention is sectioned.

FIG. 1 is a front view of a bottle can 1 according to one embodiment of the present invention. Attaching a cap (not illustrated) on an open-end portion 1*a*, the bottle can 1 is used as a container storing a beverage or the like.

The bottle can 1 is made of a thin metal of aluminum alloy of 3000 series, for example, such as JIS3000, 3004, 3104 or the like; as shown in FIG. 1, it is a solid of revolution with a can axis S as an axis, and is provided with a base portion 11, a cylindrical body portion 12 connected to an upper end of the base portion 11, a reduced diameter portion 13 in which a diameter is reduced from an upper end of the cylindrical body portion 12 toward an upper side, a neck portion 15 provided at an upper side of the reduced diameter portion 13, and a mouth portion 14 with a caliber 38 mm continued to an upper end of the neck portion 15.

The reduced diameter portion 13 has a convex curved portion 131 which is a convex outer surface from an upper end of the cylindrical body portion 12, and a concave curved portion 132 which is a concave outer surface from an upper end of the convex curved portion 131 to a lower end of the mouth portion 14.

As shown in FIG. 1, the cylindrical body portion 12, the reduced diameter portion 13, and the mouth portion 14 are coaxially arranged with each other; in the present embodiment, a common axis of these is refereed as a can axis S and explained. Hereinafter, an upper side in FIG. 1 is an upper side along the can axis S, and a lower side in FIG. 1 is a lower side along the can axis S.

The cylindrical body portion 12 is formed in a cylindrical shape that extends linearly in the direction along the can axis S; and its outer diameter D1 is set to 64 mm or more and 68 mm or less, for example, 66.2 mm. The base portion 11 formed by connected to the lower end portion of the cylindrical body portion 12 is located on the can axis S, and is provided with a dome portion 111 formed to bulge out upward (inward of the cylindrical body portion 11) and a heel portion 112 connecting an outer peripheral edge portion of the dome portion 111 and the lower end portion of the cylindrical body portion 12.

A grounding portion 113 connecting the dome portion 111 and the heel portion 112 is bended and formed to be convex downward, and brought into contact with a placement surface when the bottle can 1 is disposed on the placement surface so as to be in an upright posture (a posture shown by FIG. 1, in which the mouth portion 14 faces upward). The grounding portion 113 protrudes downward most at the base portion 11 and has an annular shape that extends in the circumferential direction. The diameter D2 of the grounding portion 113 is set to 56 mm, for example.

The reduced diameter portion 13 has the convex curved portion 131 in a curved surface having a convex outer surface on the lower side and the concave curved surface 132 in a curved surface having a concave facing surface on the upper side, and these are smoothly connected. The radius of curvature R2 of the outer surface of the upper concave curved portion 132 is larger than the radius of curvature R1 of the outer surface of the lower convex curved portion 131. Specifically, the convex curved portion 131 has the radius of curvature R1 of 45 mm or more and 80 mm or less, more preferably 50 mm or more and 70 mm or less; and the concave curved portion 132 has the radius of curvature R2 of 85 mm or more and 115 mm or less, more preferably 90 mm or more and 110 mm or less.

Figure 2:
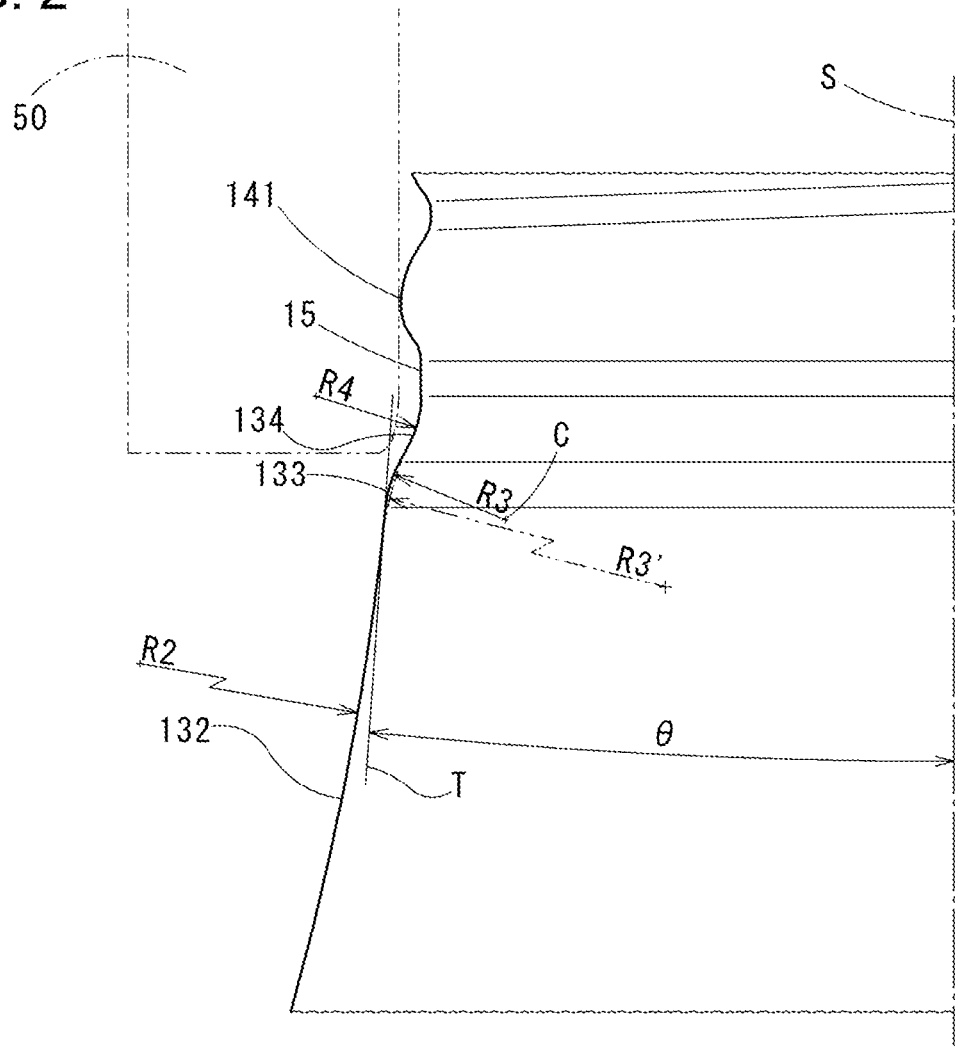
FIG. 2 is an enlarged view of an essential part of the bottle can of FIG. 1.

As shown in FIG. 2, in the upper part of the reduced diameter portion 13, a lower convex portion 133 connected to the upper end of the concave curved portion 132 and being convex outward in the radial direction in the longitudinal section including the can axis S (forming a convex outer surface) and an upper concave portion 134 continued to the upper end of the lower convex portion 133 and being concave inward in the radial direction in the longitudinal section (forming a concave outer surface) are provided.

The lower convex portion 133 is connected to the upper end of the concave curved portion 132. The upper concave portion 134 continued to the upper end of the lower convex portion 133 is connected to the lower end of the neck portion 15 in a cylindrical shape having a smaller diameter than the mouth portion 14. Therefore, the upper part of the reduced diameter portion 13 has a constricted shape continuous with the neck portion 15. That is, the upper end of the concave curved portion 132 and the lower end of the neck portion 15 are connected by the lower convex portion 133 and the upper concave portion 134.

The lower convex portion 133, the upper concave portion 134, and the neck portion 15 are smoothly connected.

In the present embodiment, a height in the direction of the can axis S from the connection position between the upper end of the cylindrical body portion 12 and the lower end of the reduced diameter portion 13 (lower end of the convex curved portion 131) and the connection position between the upper end of the reduced diameter portion 13 (upper end of the upper concave portion 134) and the lower end of the neck portion 15, i.e., a height H3 of the reduced diameter portion 13, is formed to be 40 mm or more and 70 mm or less.

The upper portion height H2 from the lower end of the reduced diameter portion 13 to the upper surface of the mouth portion 14 is formed to be 60 mm or more and 100 mm or less. The cylindrical body height H1 from the lower surface of the base portion 11 to the upper end of the cylindrical body portion 12 is formed to by 110 mm or more and 150 mm or less.

The curvature of radius R3 of the outer surface of the lower convex 133 is formed to be 2 mm or more and less than 6 mm, more preferably 4 mm or more and less than 6 mm; and the radius of curvature R4 of the outer surface of the upper concave portion 134 is formed to by 2 mm or more and 25 mm or less. As shown in FIG. 2, the connection position between the upper end of the reduced diameter portion 13 (concave curved portion 132) and the lower end of the lower convex portion 133 is located above the curvature center C of the radius of curvature R3 of the lower convex portion 133. In other words, the lower convex portion 133 has a smaller diameter toward the upper side and has not vertical portion.

Therefore, the common tangent line T of the lower end of the concave curved portion 132 and the lower end of the lower convex portion 133 in a cross section including the can axis S is inclined in a direction that gradually approaches the can axis S as it goes upward, and the inclination angle θ with respect to the can axis S is formed to be 2° or more and 120 or less. Therefore, the height of the lower convex portion 133 is formed small, and the height H3 of the reduced diameter portion 13 is formed correspondingly large.

The upper concave portion 134 forming a concave outer surface is connected to the upper end of the lower convex portion 133. The upper end of the upper concave portion 134 has a smaller diameter than the portion (upper end) having the smallest diameter in the lower convex portion 133. In other words, the upper concave portion 134 has a smaller diameter than the minimum diameter of the lower convex portion 133. The lower convex portion 133 and the upper concave portion 134 are formed in substantially "S" shape in the vertical cross section including the can axis S. Due to the lower convex portion 133 and the upper concave portion 134, the upper portion of the reduced diameter portion 13 can be sharply constricted, and the strength of the lower convex portion 133 and the upper concave portion 134 is increased.

In the conventional bottle can, like the bottle can described in Japanese Unexamined Patent Application, First Publication No. 2018-131261 described above, the reduced diameter portion is formed in a truncated cone surface shape obtained by rotating a straight line about the can axis, and is straight in the vertical cross section passing through the can axis. In a bottle can having a so-called "211 diameter" cylindrical body portion (outer diameter 64.24 to 68.24 mm) and a so-called "38 mm diameter" (outer diameter of bulge portion 36.0 mm to 40.0 mm) mouth portion, a height in the can axis direction of the reduced diameter portion is formed to be about 25 mm, for example. Accordingly, the radius of curvature of the connection portion between the cylindrical body portion and the reduced diameter portion is small, giving an angular impression as if the diameter of the bottle can suddenly changes; the outer diameter of the bottle can is linearly decreased in the reduced diameter portion, and the upper end of the reduced diameter portion is connected to the mouth portion at a small diameter.

On the other hand, the bottle can 1 of the present embodiment, the reduced diameter portion 13 connected to the upper end of the cylindrical body portion 12 is formed of a smooth curved surface (the lower convex curved portion 131 and the upper concave curved portion 132) obtained by rotating an arc about the can axis S. Moreover, the radius of curvature R1 of the convex curved portion 131 and the radius of curvature R2 of the concave curved portion 132 are both considerably larger than the radius of curvature of the connection portion between the cylindrical body portion and the reduced diameter portion in the conventional bottle can; therefore, the diameter of the bottle can 1 smoothly changes between the cylindrical body portion 12 and the mouth portion 14.

Moreover, since from the upper end of the cylindrical body portion 12 to the lower end of the neck portion 15, i.e., the height H3 of the reduced diameter portion 13 is large, there is no portion where the curvature changes abruptly, and the curvature and the outer diameter smoothly change in the direction of the can axis S as a whole.

Furthermore, the connection portion between the upper end of the concave curved portion 132 and the lower end of the lower convex portion 133 is located above the position of the curvature center C of the lower convex portion 133, and the common tangent line T of the concave curved portion 132 and the lower convex portion 133 at the connection portion is gradually inclined to approach the can axis S as it goes upward in the can axis S. Therefore, the outer surface of the concave curved portion 132 and the lower convex portion 133 have a shape in which there is no vertical portion and the diameter is reduced upward.

The mouth portion 14 has a bulge portion 141 continued to the upper end of the neck portion 15, a male thread portion 142 continued to the upper end of the bulge portion 141, and a curl portion 143 which is formed above the male thread portion 142 and forms the open-end portion 1*a*. The cap (not illustrated) is attached to be screwed into the male thread portion 142 to wind a hem part around the bulge portion 141, so that a liner on the inner surface of the cap is pressed against the curl part 143 to seal the bottle can 1.

The bulge portion 141 has a larger diameter than the neck portion 15, and its outer diameter D3 is set to 35 mm or more and 40 mm or less. A mouth height H5 from the lower end of the mouth portion 14 to the upper end of the mouth portion 14 is formed to be 15 mm or more and 20 mm or less.

[Manufacturing Method of Bottle Can]

Next, a manufacturing method of the bottle can 1 will be explained referring FIGS. 3 and 4. The manufacturing method of the bottle can 1 includes a cup forming step, a cylindrical body forming step, a step of forming a reduced diameter cylindrical portion, a reduced diameter portion forming step, a mouth portion forming step, and a reforming step. Below, these steps will be explained in order.

(Cup Forming Step)

Figures 3A, 3B, 3C, 3D, 3E:
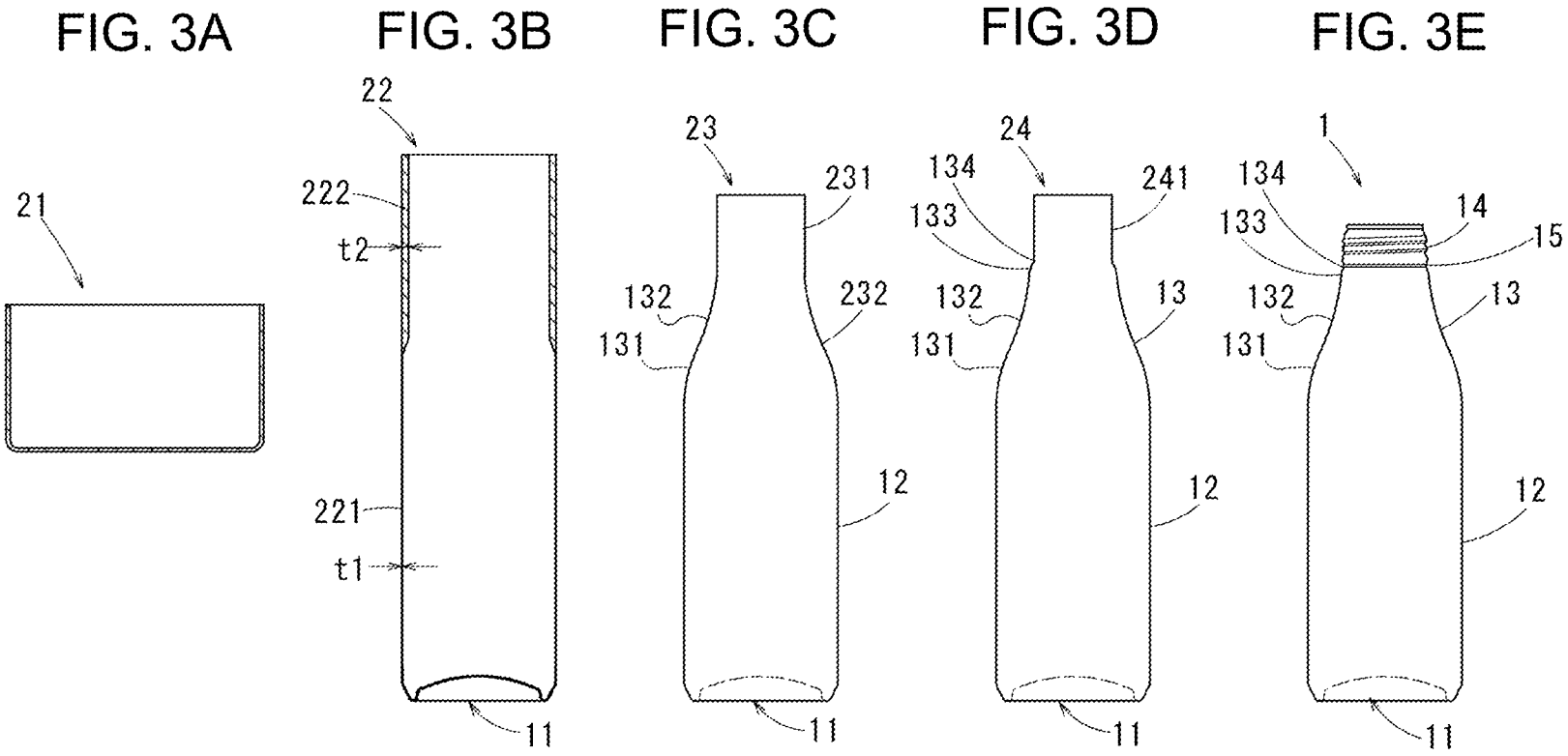
FIGS. 3A-3E are views showing changes of a bottle can in order while manufacturing.

First, a relatively large diameter and shallow cup 21 shown in FIG. 3A is formed by punching and drawing a thin sheet metal of JIS 3000 series aluminum alloy having a plate thickness of 0.480 mm or more and 0.520 mm or less.

(Cylindrical Body Forming Step)

Thereafter, the cup 21 is subjected to drawing and ironing (DI processing) again, and the upper end is trimmed by trimming, a bottomed cylindrical body 22 having a predetermined height is formed as shown in FIG. 3B. By this DI processing, the base portion of the cylindrical body 22 is formed in a final shape of the base portion 11 of the bottle can 1.

(Forming Step of Reduced Diameter Cylindrical Portion)

Next, an open-end portion side of the cylindrical body 22 is subjected to a diameter reduction processing (neck-in process), so that the reduced diameter cylindrical portion 232 continued to the cylindrical body portion 12 and a small cylindrical portion 231 is formed to extend above the reduced diameter cylindrical portion 232, to form a first intermediate formed body 23, as shown in FIG. 3C.

In this diameter reduction processing (neck-in processing), a cylindrical neck-in die is pushed downward from the open-end side of the cylindrical body 22, the cylindrical body 22 is reduced in diameter by an inner peripheral forming part of the neck-in die to form the convex curved portion 131 and the concave curved portion 132, and the reduced diameter cylindrical portion 232 is formed. The convex curved portion 131 and the concave curved portion 132 of the reduced diameter cylindrical portion 232 have a large radius of curvature and a height and a relatively gentle inclination, so that the cylinder body 22 can be easily reduced in diameter.

In the conventional bottle can manufacturing process, it is necessary to reduce the diameter of the inner peripheral molding part of the neck-in mold several times while reducing the diameter; depending on the processing, the reduced diameter portion may be formed in steps. In order to avoid it, it is necessary to reduce the processing area for one process and increase the number of times of processing.

On the other hand, in the case of the bottle can 1 of the present embodiment, since the reduced diameter cylindrical portion 232 having a relatively gentle slope with a large radius of curvature, the processing area for one neck-in processing can be increased, and the smooth reduced diameter cylindrical portion 232 can be formed.

(Reduced Diameter Portion Forming Step)

In the reduced diameter portion forming step, an upper end portion of the reduced diameter cylindrical portion 232 is formed by pressing a die (not illustrated) having a smaller diameter than the diameter of the small cylindrical portion 231 onto the upper portion of the small cylindrical portion 231 and relatively moving in the can axis S direction, to form the convex curved portion 131 and the lower convex portion 133 continued to the upper end of the concave curved portion 132 and the upper concave portion 134, so that a second intermediate formed body 24 shown in FIG. 3D is formed.

In this reduced diameter portion forming step, the lower convex portion 133 and the upper concave portion 134 are formed, and the small cylindrical portion 231 is reduced in diameter to form a second small cylindrical portion 241 having a smaller diameter than the small cylindrical portion 231.

(Mouth Portion Forming Step)

Next, the diameter of the second small cylindrical portion 241 of the second intermediate formed body 24 is expanded again and reduced to form the neck portion 15, and then the mouth portion 14 (the bulge portion 141, the male thread portion 142 and the curl portion 143) is formed, so that the bottle can 1 shown in FIG. 3E is formed.

The aluminum alloy plate (for example, JIS 3000 series aluminum alloy plate) has different elongations in the rolling direction and the intersecting direction, so that the external force at the time of manufacturing or capping tends to cause the mouth portion 14 to be deformed in an oval shape in a cross-sectional view. Since the cap is wound around the bulge portion 141 formed in the mouth portion 14 and attached to the mouth portion 14, if the mouth portion 14 is deformed into an oval shape in the cross-sectional view, it may cause a loss of sealability.

The upper side of the bulge portion 141 has a relatively high rigidity because the male thread portion 142 is molded. On the other hand, on the lower side of the bulge portion 141, since the uneven shape like the male thread 142 is not formed, the strength in the radial direction is low. Accordingly, the lower side of the bulge portion 141 in the bottle can 1 may be slightly deformed into an oval shape in a cross-sectional view.

Therefore, in the case of the bottle can 1 of the present embodiment, the radius of curvature of the lower convex portion 133 is reduced by further performing the reforming step on the bottle can 1 after the mouth portion forming step shown in FIG. 3E.

By reducing the radius of curvature of the lower convex portion 133, the rigidity of the part under the bulge portion 141 of the mouth portion 14 can be increased, and the bottle can 1 can be suppressed from being deformed due to the external force during capping; and even if the bottle can 1 is deformed into the oval shape in the cross-sectional view in the manufacturing process, it can be reformed to a perfect circle shape.

(Reforming Step)

Figure 4:
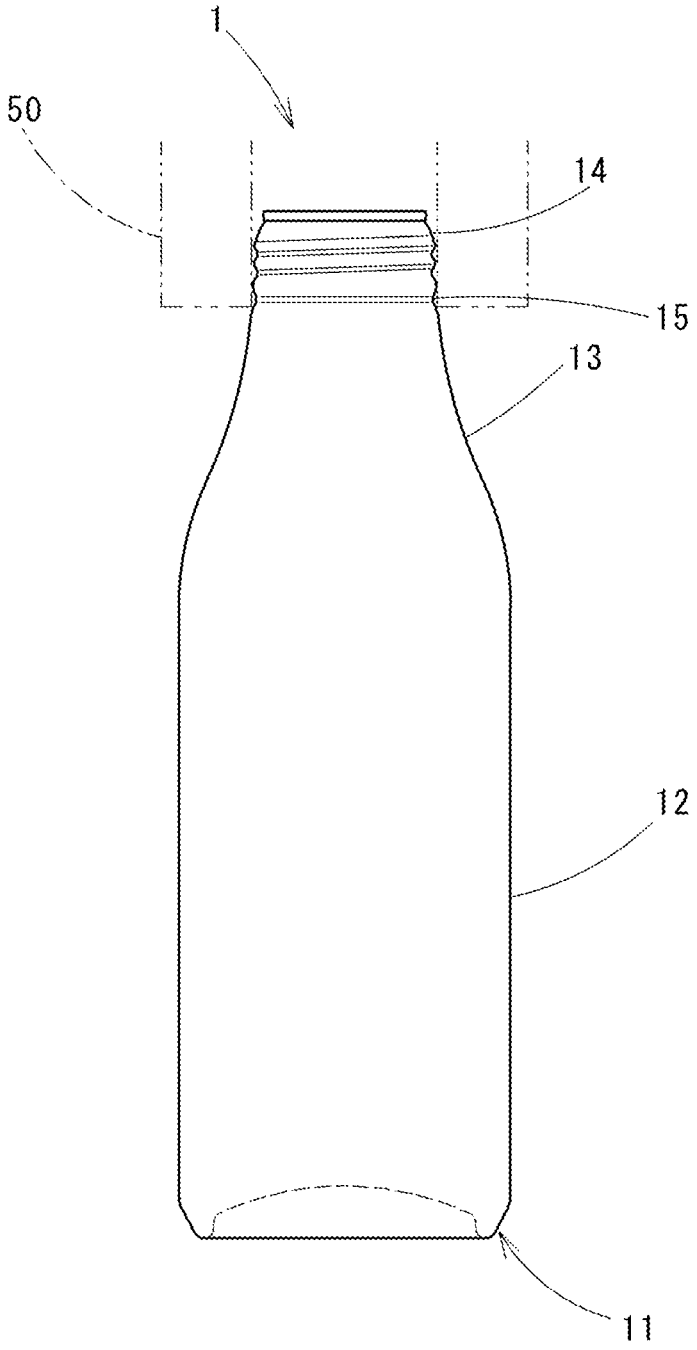
FIG. 4 is a view showing a reforming step while manufacturing a bottle can.

Specifically, as shown in FIGS. 2 and 4, a reforming mold 50 is pressed onto the upper part of the reduced portion 13 (the lower convex portion 133) of the bottle can 1, and the bottle can 1 and the reforming mold 50 are relatively moved in the direction of the can axis S. Thereby, the lower convex portion 133 having the shape shown by the two-dot chain line in FIG. 2 is pressed by the reforming mold 50 and deformed, and becomes the shape having a smaller radius of curvature shown by the solid line.

A radius of curvature R3' of the lower convex portion 133 before reforming is 6 mm or more and 8 mm or less, and a radius of curvature R3 of the lower convex portion 133 after reforming is 2 mm or more and less than 6 mm, more preferably 4 mm or more and less than 6 mm. Since the upper concave portion 134 is hardly deformed in the reforming step, the radius curvature of the upper concave portion 134 before the reforming step and the radius of curvature of the upper concave portion 134 after the reforming step are substantially the same. As a result, the bottle can 1 having a perfect circular shape in the cross-sectional view is formed.

Here, dimensions including the portion other than the above-described reduced diameter portion 13 are explained: a can height H0 of the bottle can 1 from the bottom surface of the grounding portion 113 to the upper surface of the curl portion 143 is 194 mm or more and 230 mm or less. The bottle can 1 can be used as a beverage can having an inner capacity of 400 ml or more and 600 ml or less.

In the cylindrical body 22 shown in FIG. 3B, a plate thickness (wall thickness) t1 of a lower portion 221 (base portion 11 side) is 0.125 mm or more and 0.150 mm or less, and a plate thickness (flange thickness t2) of an upper portion 222 (open-end portion side) is 0.210 mm or more and 0.240 mm or less. In this case, the portion 221 having the wall thickness t1 is from a position slightly above the base portion 11 to a portion slightly below a portion to be the convex curved portion 131 of the reduced diameter portion 13 in a later step. The portion 222 having the flange thickness t2 is an upper portion than a portion which becomes the convex curved portion 131 of the reduced diameter portion 13 in the later step. The plate thickness of the dome portion 111 of the base portion 11 is the same as the original plate thickness before processing (plate thickness 0.480 mm or more and 0.520 mm or less) or slightly smaller than the original plate thickness.

In the bottle can 1 of the present embodiment, since the lower convex portion 133 and the upper concave portion 134 are continuously provided at the upper end of the concave curved portion 132, the neck portion 15 can be smoothly connected from the concave curved portion 132, and the bottle can 1 can be improved in design, and the strength in the radial direction of the bottle can 1 in the lower convex portion 133 and the upper concave portion 134 can be increased. Moreover, by increasing the strength in the radial direction of the bottle can 1, the column strength of the bottle can 1 (compressive strength in the direction of the can axis S) can also be increased.

Further, in the bottle can 1, since the convex curved portion 131 and the concave curved portion 132 having a large radius of curvature are continuous between the cylindrical body portion 12 having a large diameter and the mouth portion 14 having a small diameter, the appearance between the cylindrical body portion 12 and the mouth portion 14 gives smooth and soft impression, and the design is excellent.

Furthermore, since the reduced diameter portion 13 is formed smoothly, the beverage flows smoothly on the inner peripheral surface of the reduced diameter portion 13 when the beverage is poured out from the mouth portion 14. Accordingly, pulsation is unlikely to occur. Particularly, in a large-capacity bottle can having a long cylindrical body portion 12, it has good pouring properties.

Furthermore, in the manufacturing process of the bottle can 1, there is a step of cleaning the inside while conveying it in an inverted posture (a posture in which the open-end portion 1*a* is directed downward); an outflow property of the cleaning liquid at this time is good, and the cleaning liquid hardly remains inside.

Moreover, when the lower part of the small-diameter mouth portion 14 is held by the thumb and forefinger, the outer surface from the concave curved portion 132 to the convex curved portion 131 is brought into contact with the concave of the palm, so that the grip feeling is also good. Accordingly, when applied to a large can having a large internal capacity, it has particularly excellent stability for holding.

Further, since there is no portion where the outer diameter changes abruptly from the cylindrical body portion 12 to the convex curved portion 131 and the concave curved portion 132 and the it gently changes, it is possible to secure a wide area for a printing surface on the outer surface of the bottle can 1 from the cylindrical body portion 12 to the reduced diameter portion 13 (the convex curved portion 131 and the concave curved portion 132) to provide the bottle can 1 having an excellent design.

Further, since the height of the neck portion 15 is small as 3 mm or more and 5 mm or less and the cylindrical body height H1 is large and the upper portion height H2 is small, the can height H0 can be small as 190 mm or more and 230 mm or less, so that the stability of the bottle can 1 during conveyance can be improved. Further, since the outer diameter D1 of the cylindrical body portion 12 is 64 mm or more and 68 mm or less and the reduced diameter portion 13 is configured by the convex curved portion 131 and the concave curved portion 132, the internal capacity of the bottle can 1 can be expanded.

Further, by reducing the radius of curvature of the lower convex portion 133 by the reforming step, it is possible to reliably correct the oval shape in the cross-section view into a perfect circular shape in the cross-section view in the bottle can. Further, since the radius of curvature of the lower convex portion 133 is small as 4 mm or more and less than 6 mm, the step formed by the lower convex portion 133 and the upper concave portion 134 can be inconspicuous.

The bottle can 1 shown in the above-described embodiment is designed as follows, for example.

First, the can height H0, the cylindrical body height H1 from the lower surface of the base portion 11 to the upper end of the cylindrical body portion 12, the upper portion height H2 from the lower end of the reduced diameter portion 13 to the upper surface of the mouth portion 14, the outer diameter D1 of the cylindrical body portion 12, an upper-neck height H4 from the lower end of the neck portion 15 to the upper surface of the mouth portion 14, the mouth height H5 from the lower end of the mouth portion 14 to the upper surface of the mouth portion 14, and the outer diameter D3 of the bulge portion 141 are set respectively (dimension setting step).

Next, the radius of curvature R1 of the convex curved portion 131 and the radius of curvature R2 of the concave curved portion 132 are set and the position of the upper end of the concave curved portion 132 is determined (a form setting step of the reduced diameter portion).

Finally, forms of the lower convex portion 133 connecting between the upper end of the concave curved portion 132 and the lower end of the neck portion 15 and forming a convex outer surface continued to the concave curved portion 132 and the upper concave portion 134 forming a concave outer surface continued to the upper side of the lower convex portion 133 and the neck portion 15 are set (a setting step of connection form).

According to the above-described design method, after setting the various dimensions such as the can height of the bottle can 1, the shape of the reduced diameter portion 13 is set, and the forms of the upper concave portion 134 and the lower convex portion 133 are set so as to smoothly connect the concave curved portion 132 and the neck portion 15; so that it is reliably possible to design the stable bottle can 1 having good design and high strength in the radial direction.

The present invention is not limited to the above-described embodiment and various modifications may be made without departing from the scope of the present invention. For example, as a bottle can, a cylindrical body having a bottomed cylindrical shape is formed in advance and then an open-end portion thereof is formed; however, it may include the cylindrical body without the base portion, and it may be also applicable that after forming the reduced diameter portion, a base portion which is separately formed is wound around the body portion of the cylindrical body.

EXAMPLES

Next, the effect of the present invention will be demonstrated. Using aluminum alloy material of H16 3104 with after-baking strength of 215 MPa to 235 MPa having a plate thickness of 0.505 mm before press molding, a DI can having a wall thickness of 0.135 mm and a flange thickness of 0.225 mm was formed; and then, a bottle can having an outer diameter of the cylindrical body portion of 66.24 mm, an outer diameter of the bulge portion of the mouth portion of 38.0 mm and an overall height of 203 mm was formed.

Example 1

In Example 1, a bottle can in which the radius of curvature of the convex curved portion was 60 mm and the radius of curvature of the concave curved portion was 100 mm, and the lower convex portion having the radius of curvature of 5 mm and the upper concave portion having the radius of curvature of 4 mm were formed at the upper end portion of the concave curved portion was molded.

Comparative Example 1

Figure 5:
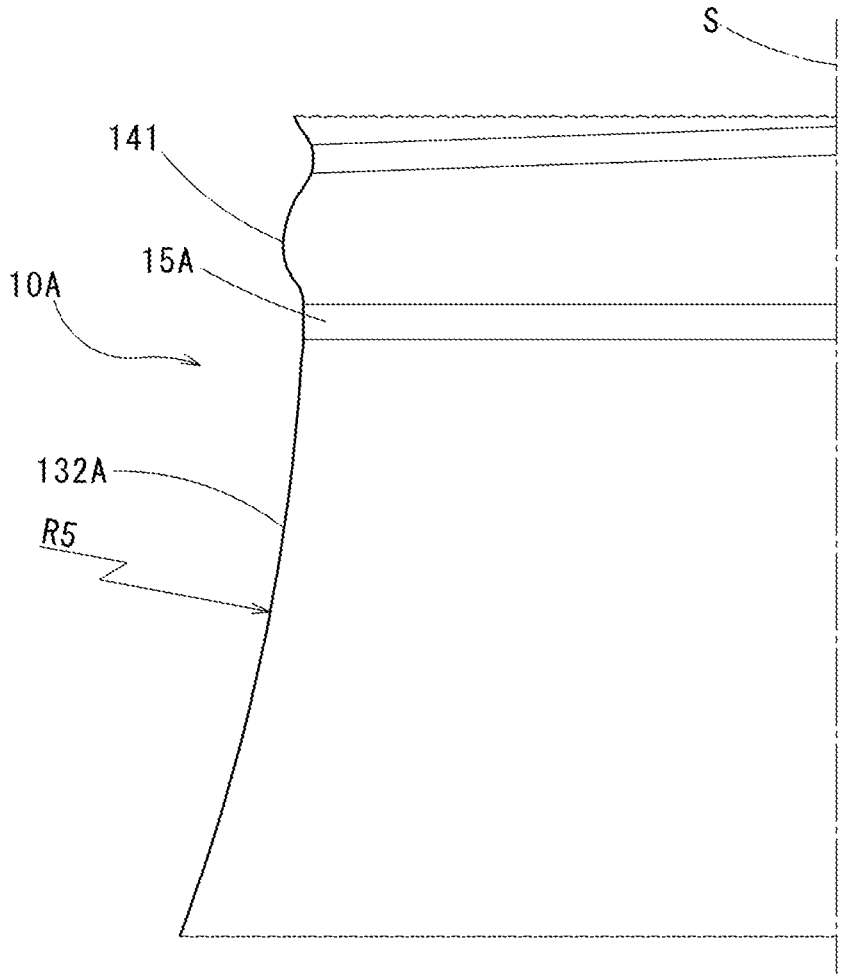
FIG. 5 is an enlarged view of an essential part of a bottle can according to Comparative Example of the present invention.

On the other, in Comparative Example 1, a bottle can 10A shown in FIG. 5 was used; in the bottle can 10A, an upper end of a concave curved portion 132A having a radius of curvature R5 of 100 mm was directly connected to a neck portion 15A, that is, the lower convex portion and the upper concave portion were not formed. The shapes of the bottle can 1 of Example 1 and the bottle can 10A of Comparative Example 1 were the same except that the shape of the lower end portion of the neck portion 15A was different.

10 cans of samples of Example 1 were manufactured by the above-described method; and ten cans of samples of Comparative Example 1 were manufactured by a method in which the reduced diameter portion forming step and the reforming step were not performed.

Then, the column strength of the respective samples of Example 1 and Comparative Example 1 was measured. The column strength was determined, by bringing a flat plate into contact with the upper surface of the mouth portion (open-end portion) of the bottle can and compressing it in the axial direction at a speed of 5 mm/min using a tester made of Shimazu Corporation (model number AG-50kNG), from a load when buckling started. Results are shown in Table 1. Each shows the average value of 10 cans.

TABLE 1

| | Lower Convex Portion and Upper Concave Portion | Column Strength |
|---|---|---|
| Example 1 | Present | 1800N |
| Comparative Example 1 | Not Present | 1600N |

As shown in Table 1, the column strength of the bottle cans of Example 1 was high as 1800 N. Accordingly, it can be seen that the column strength was increased in Example 1 by providing the lower convex portion and the upper concave portion having high strength in the radial direction, so that the deformation during capping and the like can be suppressed.

On the other, in Comparative Example 1, since the reduced diameter portion forming step and the reforming step were not performed and the lower convex portion and the upper concave portion were not formed, the strength in the radial direction of the lower convex portion and the upper concave portion was not increased, so that the column strength was low.

Example 2

Using aluminum alloy material of H16 3104 with after-baking strength of 215 MPa to 235 MPa having an original plate thickness 0.46 mm, a bottomed-cylindrical body having a wall thickness of 0.130 mm and a flange thickness of 0.220 mm was molded, and a bottle can having an outer diameter of the cylindrical body portion of 66.24 mm and an outer diameter of the bulge portion of 38.0 mm was formed. A plurality of samples were formed to have the different cylindrical body height H1, the height H3 of the reduced diameter portion, the radius of curvature R1 of the convex curved portion and the radius of curvature R2 of the concave curved portion, and the presence of lower convex portion and the upper concave portion; and the molding property was evaluated and the column strength was measured.

The column strength was measured by the same method as in Example 1 and Comparative Example 1 described above.

Regarding the molding property, the presence of vertical wrinkles (pleats) extending in the axis direction of the can and ring-shaped molding marks (indentations) formed in the reduced diameter portion were visually confirmed.

TABLE 2

| Sample | H1 (mm) | H3 (mm) | R1 (mm) | R2 (mm) | Lower Convex Portion and Upper Concave Portion | COLUMN STRENGTH | Molding Performance Vertical Wrinkles | Molding Performance Molding Marks |
|---|---|---|---|---|---|---|---|---|
| 1 | 119.5 | 61.2 | 60 | 100 | Present | 1800 | Not Present | |
| 2 | 129.6 | 51.0 | 45 | 85 | Present | 1800 | Not Present | |
| 3 | 119.1 | 61.6 | 75 | 115 | Present | 1800 | Not Present | |
| 4 | 119.8 | 60.9 | 80 | 100 | Present | 1800 | Not Present | |
| 5 | 135.2 | 45.5 | 40 | 60 | Not Present | 1600 | Present | Not Present |
| 6 | 117.3 | 63.3 | 80 | 120 | Not Present | 1800 | Not Present | Present |
| 7 | 128.6 | 52.1 | 65 | 60 | Not Present | 1700 | Present Not | Present |

As shown in Table 2, in samples 1 to 4 having the lower convex portion and the upper concave portion and the radius of curvature R1 of 45 mm or more and 80 mm or less and the radius of curvature R2 of 85 mm or more and 115 mm or less, the column strength was sufficiently high as 1800 N, the pleats and the molding marks were not recognized, and the molding property was also good. The inclination angle θ of the common tangent line T between the lower convex portion and the convex curved portion in the samples 1 to 4 were 4 to 6°.

In the sample 5 having neither the lower convex portion and the upper concave portion and the small radius of curvature R1 and R2, the column strength was low and the pleats were recognized. In the sample 6 having neither the lower convex portion and the upper concave portion and the large radius of curvature R2, the molding marks were recognized. In the sample 7 having neither the lower convex portion and the upper concave portion and the small radius of curvature R2, the column strength was low and the pleats were recognized.

INDUSTRIAL APPLICABILITY

The strength of the bottle can in the radial direction can be improved, the reduced diameter portion between the cylindrical body portion and the mouth portion has the smooth and soft appearance, and the pouring performance can be improved even with a large capacity.

REFERENCE SIGNS LIST

22 Cylindrical body

The invention claimed is:

1. A bottle can made of aluminum alloy, comprising:

a base portion;

a cylindrical body portion having a cylindrical shape connected to an upper end of the base portion;

a reduced diameter portion wherein a diameter reduces from an upper end of the cylindrical body portion to an upper side;

a neck portion provided at the upper side of the reduced diameter portion; and a mouth portion having a male thread portion and a bulge portion provided at an upper side of the neck portion and bulging out in a radial direction, wherein the reduced diameter portion is provided with:

a convex curved portion forming a convex outer surface extending from the upper end of the cylindrical body portion;

a concave curved portion forming a concave outer surface extending from an upper end of the convex curved portion;

a lower convex portion forming a convex outer surface extending from an upper end of the concave curved portion; and an upper concave portion forming a concave outer surface continuing between an upper end of the lower convex portion and a lower end of the neck portion, wherein a radius of curvature of the outer surface of the convex curved portion is not less than 45 mm and not more than 80 mm, and a radius of curvature of the outer surface of the concave curved portion is not less than 85 mm and not more than 115 mm, and a height of the reduced diameter portion in an axial direction is not less than 40 mm and not more than 70 mm.

2. The bottle can according to claim 1, wherein a radius of curvature of the outer surface of the lower convex portion is not less than 2 mm and not more than 6 mm.

3. The bottle can according to claim 2, wherein a can height from a lower surface of the base portion to an upper surface of the mouth portion is not less than 194 mm and not more than 230 mm, a cylindrical body height from the lower surface of the base portion to an upper end of the cylindrical body portion is not less than 110 mm and not more than 150 mm, an upper portion height from a lower end of the reduced diameter portion to the upper surface of the mouth portion is not less than 60 mm and not more than 100 mm, an outer diameter of the cylindrical body portion is not less than 64 mm and not more than 68 mm, an upper-neck height from a lower end of the neck portion to the upper surface of the mouth portion is not less than 18 mm and not more than 24 mm, a mouth height from a lower end of the mouth portion to the upper surface of the mouth portion is not less than 15 mm and not more than 20 mm, and an outer diameter of the bulge portion is not less than 35 mm and not more than 40 mm.

4. A manufacturing method of the bottle can according to claim 3 comprising:

a cup forming step punching out an aluminum alloy sheet to form a cup;

a cylindrical body forming step carrying out a drawing process and an ironing step on the cup to form a cylindrical body;

a step of forming a reduced diameter cylindrical portion reducing a diameter of the cylindrical body toward an upper side of the can axis direction, to form a reduced diameter cylindrical portion having the convex curved portion and the concave curved portion and to form a small cylindrical portion continued to an upper end of the reduced diameter cylindrical portion and linearly extending upward;

a step of forming a reduced diameter portion by pressing a mold having a smaller diameter than a diameter of the small cylindrical portion on an upper end portion of the small cylindrical portion and relatively moving in the can axis direction to form the reduced diameter portion by forming the lower convex portion and the upper concave portion continuing to an upper end of the concave curved portion and to form a second small cylindrical portion continuing to an upper end of the upper concave portion with a smaller diameter than the small cylindrical portion; and a mouth portion forming step forming the bulge portion on an upper end portion of the second small cylindrical portion and the male thread portion on an upper side of the bulge portion in the can axis direction.

5. A manufacturing method of the bottle can according to claim 2, comprising:

a cup forming step punching out an aluminum alloy sheet to form a cup;

a cylindrical body forming step carrying out a drawing process and an ironing step on the cup to form a cylindrical body;

a step of forming a reduced diameter cylindrical portion reducing a diameter of the cylindrical body toward an upper side of the can axis direction, to form a reduced diameter cylindrical portion having the convex curved portion and the concave curved portion and to form a small cylindrical portion continued to an upper end of the reduced diameter cylindrical portion and linearly extending upward;

a step of forming a reduced diameter portion by pressing a mold having a smaller diameter than a diameter of the small cylindrical portion on an upper end portion of the small cylindrical portion and relatively moving in the can axis direction to form the reduced diameter portion by forming the lower convex portion and the upper concave portion continuing to an upper end of the concave curved portion and to form a second small cylindrical portion continuing to an upper end of the upper concave portion with a smaller diameter than the small cylindrical portion; and a mouth portion forming step forming the bulge portion on an upper end portion of the second small cylindrical portion and the male thread portion on an upper side of the bulge portion in the can axis direction.

6. The bottle can according to claim 1, wherein a can height from a lower surface of the base portion to an upper surface of the mouth portion is not less than 194 mm and not more than 230 mm, a cylindrical body height from the lower surface of the base portion to an upper end of the cylindrical body portion is not less than 110 mm and not more than 150 mm, an upper portion height from a lower end of the reduced diameter portion to the upper surface of the mouth portion is not less than 60 mm and not more than 100 mm, an outer diameter of the cylindrical body portion is not less than 64 mm and not more than 68 mm, an upper-neck height from a lower end of the neck portion to the upper surface of the mouth portion is not less than 18 mm and not more than 24 mm, a mouth height from a lower end of the mouth portion to the upper surface of the mouth portion is not less than 15 mm and not more than 20 mm, and an outer diameter of the bulge portion is not less than 35 mm and not more than 40 mm.

7. A manufacturing method of the bottle can according to claim 6, comprising:

a cup forming step punching out an aluminum alloy sheet to form a cup;

a cylindrical body forming step carrying out a drawing process and an ironing step on the cup to form a cylindrical body;

a step of forming a reduced diameter cylindrical portion reducing a diameter of the cylindrical body toward an upper side of the can axis direction, to form a reduced diameter cylindrical portion having the convex curved portion and the concave curved portion and to form a small cylindrical portion continued to an upper end of the reduced diameter cylindrical portion and linearly extending upward;

a step of forming a reduced diameter portion by pressing a mold having a smaller diameter than a diameter of the small cylindrical portion on an upper end portion of the small cylindrical portion and relatively moving in the can axis direction to form the reduced diameter portion by forming the lower convex portion and the upper concave portion continuing to an upper end of the concave curved portion and to form a second small cylindrical portion continuing to an upper end of the upper concave portion with a smaller diameter than the small cylindrical portion; and a mouth portion forming step forming the bulge portion on an upper end portion of the second small cylindrical portion and the male thread portion on an upper side of the bulge portion in the can axis direction.

8. A manufacturing method of the bottle can according to claim 1, comprising:

a cup forming step punching out an aluminum alloy sheet to form a cup;

a cylindrical body forming step carrying out a drawing process and an ironing step on the cup to form a cylindrical body;

a step of forming a reduced diameter cylindrical portion reducing a diameter of the cylindrical body toward an upper side of the can axis direction, to form a reduced diameter cylindrical portion having the convex curved portion and the concave curved portion and to form a small cylindrical portion continued to an upper end of the reduced diameter cylindrical portion and linearly extending upward;

a step of forming a reduced diameter portion by pressing a mold having a smaller diameter than a diameter of the small cylindrical portion on an upper end portion of the small cylindrical portion and relatively moving in the can axis direction to form the reduced diameter portion by forming the lower convex portion and the upper concave portion continuing to an upper end of the concave curved portion and to form a second small cylindrical portion continuing to an upper end of the upper concave portion with a smaller diameter than the small cylindrical portion; and a mouth portion forming step forming the bulge portion on an upper end portion of the second small cylindrical portion and the male thread portion on an upper side of the bulge portion in the can axis direction.

9. The manufacturing method of a bottle can according to claim 8, further comprising a reforming step reducing the radius of curvature of the lower convex portion by pressing a reforming mold on an upper part of the lower convex portion and relatively moving in the can axis direction.

* * * * *